US009365266B2

(12) United States Patent
Liner

(10) Patent No.: US 9,365,266 B2
(45) Date of Patent: Jun. 14, 2016

(54) INDEPENDENT CORRUGATED LNG TANK

(75) Inventor: David A. Liner, The Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 1459 days.

(21) Appl. No.: 12/530,948

(22) PCT Filed: Mar. 13, 2008

(86) PCT No.: PCT/US2008/003335

§ 371 (c)(1), (2), (4) Date: Sep. 11, 2009

(87) PCT Pub. No.: WO2008/133785

PCT Pub. Date: Nov. 6, 2008

(65) Prior Publication Data

US 2010/0083671 A1 Apr. 8, 2010

Related U.S. Application Data

(60) Provisional application No. 60/926,377, filed on Apr. 26, 2007.

(51) Int. Cl.
*F17C 13/08* (2006.01)
*B63B 25/16* (2006.01)
(Continued)

(52) U.S. Cl.
CPC ..... *B63B 25/16* (2013.01); *B21D 51/18* (2013.01); *B63B 25/08* (2013.01); *F17C 1/002* (2013.01);
(Continued)

(58) Field of Classification Search
CPC ..... F17C 2221/033; F17C 2260/016; F17C 2223/0161; F17C 2270/0105; F17C 13/08; F17C 2201/00; F17C 2203/00; F17C 2203/0631; F17C 1/002; B63B 25/08; B63B 25/16; B21D 51/18
USPC ..... 62/45.1, 53.2; 220/560.04, 560.07, 220/560.12
See application file for complete search history.

(56) References Cited

U.S. PATENT DOCUMENTS 1,826,859 A 10/1931 Anderson
2,008,640 A 7/1935 Fraser
(Continued)

FOREIGN PATENT DOCUMENTS

GB 619436 3/1949
GB 635112 4/1949
(Continued)

OTHER PUBLICATIONS

European Search Report No. 115419, Nov. 14, 2007, 3 pages.
(Continued)

*Primary Examiner* — Frantz Jules
*Assistant Examiner* — Webeshet Mengesha
(74) *Attorney, Agent, or Firm* — ExxonMobil Upstream Research Company Law Dept.

(57) ABSTRACT

A method and apparatus for transporting LNG are provided. A storage container is disclosed including a support frame fixedly attached to at least one top panel, at least one bottom assembly, and a plurality of corrugated side panels, wherein the support frame is externally disposed around the storage container; wherein the support frame is configured to operably engage at least a portion of a hull of a marine vessel; and wherein the storage container is an enclosed, liquid-tight, self-supporting storage container. A method of manufacturing the storage container is also provided.

26 Claims, 8 Drawing Sheets

(51) Int. Cl.

| | |
|---|---|
| *B63B 25/08* | (2006.01) |
| *F17C 1/00* | (2006.01) |
| *B21D 51/18* | (2006.01) |

(52) U.S. Cl.

CPC ..... *F17C 13/08* (2013.01); *F17C 2201/00* (2013.01); *F17C 2201/018* (2013.01); *F17C 2203/00* (2013.01); *F17C 2221/033* (2013.01); *F17C 2223/0161* (2013.01); *F17C 2260/016* (2013.01); *F17C 2270/0105* (2013.01); *Y10T 29/49826* (2015.01)

(56) References Cited

U.S. PATENT DOCUMENTS

| | | | | |
|---|---|---|---|---|
| 2,218,688 | A | | 10/1940 | Stewart |
| 2,585,980 | A | | 2/1952 | Vasta |
| 2,741,208 | A | | 4/1956 | Albiach |
| 3,118,523 | A | | 1/1964 | Girot |
| 3,302,359 | A | | 2/1967 | Alleaume |
| 3,313,116 | A | | 4/1967 | Nonnecke et al. |
| 3,319,431 | A | * | 5/1967 | Clarke et al. ..... 62/53.2 |
| 3,510,278 | A | | 5/1970 | Alleaume |
| 3,547,302 | A | | 12/1970 | Jackson |
| 3,595,430 | A | | 7/1971 | Massac |
| 3,670,517 | A | * | 6/1972 | Nonnecke ..... 62/53.2 |
| 3,719,302 | A | | 3/1973 | Hamilton |
| 3,721,362 | A | * | 3/1973 | Bridges et al. ..... 220/560.06 |
| 3,800,970 | A | | 4/1974 | Jackson |
| 3,811,593 | A | | 5/1974 | Bridges et al. |
| 3,927,788 | A | | 12/1975 | Zinniger et al. |
| 3,941,272 | A | * | 3/1976 | McLaughlin ..... 220/560.11 |
| 3,978,808 | A | | 9/1976 | Cuneo et al. |
| 4,032,608 | A | | 6/1977 | Zinniger et al. |
| 4,037,552 | A | | 7/1977 | Torroja |
| 4,101,045 | A | | 7/1978 | Roberts et al. |
| 4,116,150 | A | | 9/1978 | McCown |
| 4,207,827 | A | | 6/1980 | Gondouin |
| 4,744,321 | A | | 5/1988 | Pfeuffer et al. |
| 5,375,547 | A | | 12/1994 | Abe et al. |
| 5,531,178 | A | | 7/1996 | Abe et al. |
| 5,727,492 | A | | 3/1998 | Cuneo et al. |
| 6,626,121 | B1 | | 9/2003 | Libaek |
| 6,626,319 | B2 | * | 9/2003 | Miller et al. ..... 220/560.07 |
| 6,729,492 | B2 | | 5/2004 | Gulati |
| 6,732,881 | B1 | | 5/2004 | Gulati |
| 6,971,537 | B2 | | 12/2005 | Enright, Jr. |
| 6,981,305 | B2 | | 1/2006 | Gulati |
| 7,100,261 | B2 | | 9/2006 | Gulati |
| 7,111,750 | B2 | | 9/2006 | Gulati et al. |
| 2004/0108319 | A1 | | 6/2004 | Bettinger |
| 2008/0314908 | A1 | | 12/2008 | Bakken |

FOREIGN PATENT DOCUMENTS

| | | |
|---|---|---|
| GB | 1054641 | 1/1967 |
| GB | 1187304 | 4/1970 |
| JP | 41-010592 | 6/1966 |
| JP | 55-115696 | 9/1980 |
| JP | 57-58922 | 4/1982 |
| JP | 60-183286 | 9/1985 |
| JP | 60-261790 | 12/1985 |
| JP | 3-193588 | 8/1991 |
| JP | 3-207595 | 10/1991 |
| JP | 6-270986 | 9/1994 |
| JP | 6-321287 | 11/1994 |
| JP | 2001-30975 | 2/2001 |

OTHER PUBLICATIONS

JP 2004-4314741—computer translation of Abstract into English.
JP 60-261790—computer translation of Abstract into English.
JP 3-193588—computer translation of Abstract into English.
JP 6-270986—computer translation of Abstract into English.
JP 6-321287—computer translation of Abstract into English.
JP 2001-30975—computer translation of Abstract into English.
JP 55-115696—computer translation of Abstract into English.
JP 57-58922—computer translation of Abstract into English.
JP 60-183286—computer translation of Abstract into English.
IHI Corporation, "Offshore Projects & Steel Structures Operations", 2009, 31 pages.
http://www.ihi.co.jp/en/all_news/2003/press/2004-3-172/index.html IHI Corporation, "IHI to License SPB LNG Technology to Samsung", Mar. 17, 2004, 1 page.
NOI Shipping, "Development of Membrane Containment Systems for Application to LNG Carriers", Jun. 14, 2007, 24 pages.
English translation of Japanese Patent Publication, JP 41-010592, published Jun. 11, 1966, 7 pages.
English (machine) translation of the Abstract of Japanese Patent Publication, JP 3-207595, published Oct. 9, 1991, 1 page.

* cited by examiner

INDEPENDENT CORRUGATED LNG TANK

CROSS REFERENCE TO RELATED APPLICATIONS

This application is the National Stage of International Application No. PCT/US2008/003335, filed Mar. 13, 2008, which claims the benefit of U.S. Provisional Application No. 60/926,377, filed Apr. 26, 2007.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

The storage of large quantities of liquefied natural gas (LNG) at ambient pressure poses many technical problems. Of particular concern are the thermal loads and deflections imposed by the large temperature difference (~180 deg C.) between a tank filled with LNG and an empty tank at ambient temperature. To mitigate the risk of structural failure or leaks, a high quality of fabrication is required resulting in high costs. For marine applications such as LNG tanks in ships or offshore facilities, additional problems are introduced due to dynamic loads and the deflection of the vessel due to waves.

Various designs have been developed which attempt to address these problems as well as other issues related to LNG containment. The most popular designs for shipboard applications are the membrane LNG tank and the spherical Moss tank. The membrane ship employs several tight layers of insulation on the inside of the hull's structure to protect the hull structure from the cold temperatures of the cargo. The Moss ship uses several large spheres which are supported at their equator by a skirt which isolates the cold temperatures of the cargo from the steel hull.

However, both membrane ships and Moss ships are labor intensive to construct. Membrane ships may be less expensive to construct than the Moss ships but are more susceptible to damage due to internal loads from sloshing cargo. The tanks of the Moss ship extend above the main deck and leave very little deck area on which equipment can be fitted. The lack of deck space afforded by the Moss design is of particular concern for offshore facilities where multiple large pieces of equipment are required to be fitted on-deck.

Both of these containment systems employ materials which are not typically handled by normal shipyards. Both designs require complex fabrication methods and a significant investment in facilities to enable the construction of these ships. Due to this large initial investment, only a handful of shipyards are currently able to construct LNG ships.

Another cargo containment system for marine applications is the self-supporting prismatic type B (SPB) tank disclosed in at least U.S. Pat. Nos. 5,531,178 and 5,375,547. The SPB tank is a prismatic aluminum, 9% Ni, or stainless steel tank which is free standing and rests on the inner bottom of a vessel's hull. The bulkheads, tank top, and bottom of the tank are fabricated with a traditional grillage of stiffeners and girders. The tank is supported by an array of steel & wooden chocks and is provided with external insulation to protect the hull from the cold temperatures of the cargo.

However, this system is considerably more expensive to build than membrane or Moss ships. This system is costly because the materials needed to handle the cold temperatures, aluminum, 9% Ni, or stainless steel, cannot be handled by magnets and are thus not able to be fabricated using much of the automated machinery used by shipyards in their normal construction. This results in a very labor-intensive manual fabrication process which is costly and prone to quality problems.

Reference is also made to U.S. Pat. No. 3,721,362 "Double Wall Corrugated LNG Tank." This design employs independent prismatic tanks with bulkheads and decks comprised of a sandwich of two corrugated plates supported by a grillage of girders. The corrugations of the "Double Wall" design are longitudinal and the joining of the double plating would require significant welding and result in a void space which would be very difficult to inspect.

Accordingly, the need exists for an improved liquid-tight tank capable of withstanding sloshing loads, expansion/contraction loads, and external loads, and is relatively easy to manufacture.

SUMMARY OF INVENTION

In one embodiment, a storage container is disclosed. The storage container includes a support frame fixedly attached to at least one top panel, at least one bottom assembly, and a plurality of corrugated side panels having corrugations, wherein the support frame is externally disposed around the storage container; wherein an interior surface of the at least one top panel, at least one bottom assembly, and plurality of side panels is an interior surface of the storage container and an exterior surface of the at least one top panel, at least one bottom assembly, and plurality of side panels is an exterior surface of the storage container; wherein the support frame is configured to operably engage at least a portion of a hull of a marine vessel; and wherein the storage container is an enclosed, liquid-tight, self-supporting storage container. In particular alternative embodiments, the corrugations of the plurality of corrugated side panels have a substantially vertical orientation, the support frame is configured to transmit a bending stress from at least one of the plurality of corrugated side panels to at least one of the at least one top panel, the support frame comprises a plurality of box girders, the storage container has a substantially prismatic geometry, and/or the storage container is configured to store liquefied natural gas.

In another embodiment, a method of manufacturing a storage container is disclosed. The method comprises producing a plurality of corrugated panels utilizing an automated process; producing a bottom assembly; producing a support frame; and fixedly attaching the bottom assembly and the plurality of corrugated metal panels to the support frame to form the storage container, wherein the storage container is an enclosed, liquid-tight, self-supporting storage container, the support frame is externally disposed around the storage container, and the support frame is configured to operably engage at least a portion of a hull of a marine vessel.

In a third embodiment, a method of transporting liquefied gas is disclosed. The method includes providing a marine vessel having at least one enclosed, liquid-tight, self-supporting storage container. The container comprises a support frame fixedly attached to at least one top panel, at least one bottom assembly, and a plurality of corrugated side panels, wherein the support frame is disposed around an external perimeter of the storage container; and delivering liquefied gas to a terminal.

BRIEF DESCRIPTION OF THE DRAWINGS

The foregoing and other advantages of the present technique may become apparent upon reading the following detailed description and upon reference to the drawings in which.

DETAILED DESCRIPTION

Figure 1A:
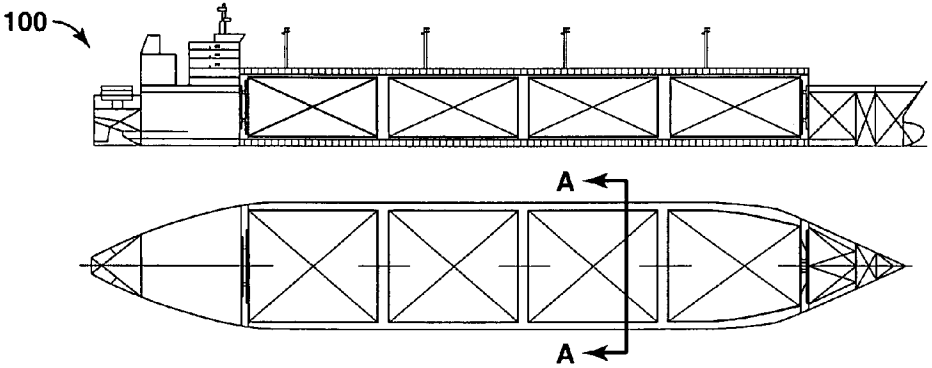
FIGS. 1A-1C illustrate an exemplary configuration of a plurality of containers of the present invention in a ship.

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

Some embodiments of the present invention relate to an enclosed, liquid-tight, free-standing storage container formed, at least in part, from corrugated bulkheads and configured to store or transport liquefied gasses at very low temperatures. The container may be economically fabricated, is robust with regard to internal sloshing loads, and when integrated into a marine vessel results in a flush or flat deck on the vessel. In some embodiments, the storage container comprises a stand-alone support frame disposed around an external perimeter of the container comprising at least one box girder. The corrugated bulkheads may be fixedly attached to the frame such that the frame transfers bending stress between the top, bottom and sides of the storage container and the corrugated bulkheads provide structural integrity to the storage container eliminating the need for an internal support frame, which may consist of internal trusses, webs, or other stiffeners. Further, the top portion may also be corrugated.

Some embodiments of the present invention include a free-standing, self-supporting, or "independent" prismatic liquid-tight tank for marine applications. More specifically, the tank may be utilized for the transport of liquefied natural gas (LNG) across large bodies of water, such as seas or oceans. The tank may carry LNG at about negative 163 degrees Celsius (° C.) and near ambient pressure. Other liquefied gasses such as propane, ethane, or butane may be transported using the container of the present invention. The temperature may be less than about 50° C., less than about 100° C., or less than about 150° C. In some embodiments, a plurality of tanks are configured to rest inside the hull of a marine vessel while remaining independent from the hull such that if the tank deflects, it does not cause stress on the hull of the vessel. The marine vessel may be a ship, a Floating Storage and Regasification Unit (FSRU), a Gravity Based Structure (GBS), a Floating Production Storage and Offloading unit (FPSO), or similar vessel.

A manufacturing process or method is also disclosed. Some embodiments of the storage container of the present invention may be fabricated separately from a vessel, then installed in the vessel after fabrication. Top and side panels of the container may be pressed into corrugations and welded using an automated welding process, then attached to the frame and the bottom portion of the container, and then fitted with insulating panels.

Figure 1B:
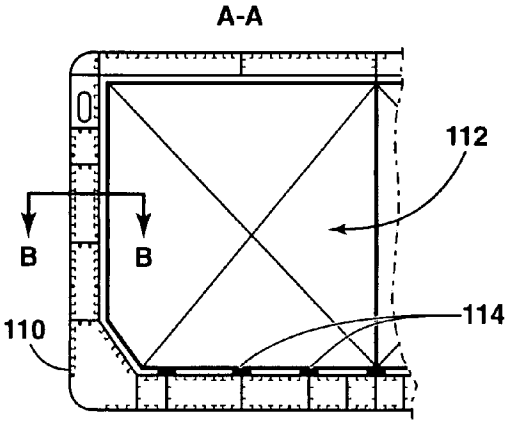
Figure 1C:
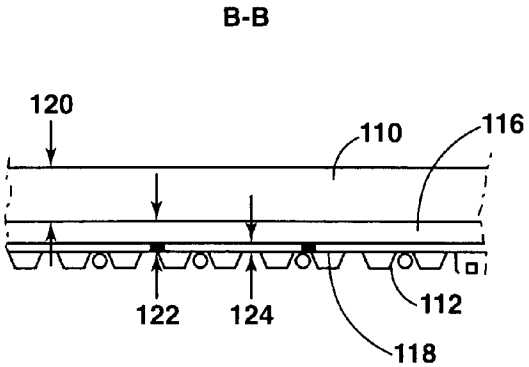

Referring now to the figures, FIGS. 1A-1C illustrate an exemplary placement of a plurality of containers 112 of the present invention in a ship 100. Although FIG. 1A illustrates four containers 112 in the ship 100, any number of containers may be used and the invention is not limited to use on or with a ship 100. Note that the containers may take on a variety of shapes so long as they are generally prismatic, meaning that the containers have substantially flat outer surfaces rather than curved or rounded outer surfaces. FIG. 1B illustrates an exemplary cross-sectional illustration of a container 112 in the ship 100 showing the inside of the hull 110 and a plurality of support chocks 114 between the inner-bottom of the hull 110 and the container 112. FIG. 1C illustrates an exemplary cross-sectional illustration of the hull 110 of the ship 100 having a thickness 120, one wall of the container 112 with a layer of insulating material 118 having a thickness 124, and a clearance 116 having a thickness 122 between the hull 110 and the wall 112. Note that the thicknesses 120, 122, and 124 are relative and approximate and only shown for illustrative purposes.

The insulating material 118 may be any material primarily designed to thermally insulate the hull of the ship 100 from the material in the container 112. In one preferred embodiment, the layer of insulating material 118 may be manufactured from polystyrene and/or polyurethane. The insulating material may be formed as sheets or panels that surround the container or tank 112 except where chocks 114 are located. The insulation panels, for example, may "bridge" between corrugations to reduce the surface area of the container 112 contacting the insulating material 118, thus reducing the amount of insulation 118 required and reducing heat transfer between the container 112 and the surrounding hold (inside portion of the hull 110). The insulating panels 118 may further comprise a secondary barrier around its exterior in the form of a foil membrane (not shown). In the unfortunate event of a partial container 112 leak, the leaked contents of the container 112 may be contained within the foil membrane and collected in troughs (not shown) strategically located at low points on the container 112 adjacent to the support chocks 114.

In preferred embodiments, the thickness 120 of the hull 110 is determined from design considerations for the marine vessel. Preferably, there is no need to reinforce the hull 110 to accommodate the hydrostatic loads from the contents of the container(s) 112 because the container(s) 112 are designed to be independent from the hull 110. The space 122 between the hull 110 and the container(s) 112 is preferably configured to allow the container(s) 112 to expand, contract, and otherwise deflect without impinging on the hull 110. The thickness 124 of the insulating panels 118 is preferably sufficient to prevent substantial heat transfer from the container(s) 112 to the hull 110, but not so substantial that it diminishes the clearance 122 below its effective configuration.

Figure 2:
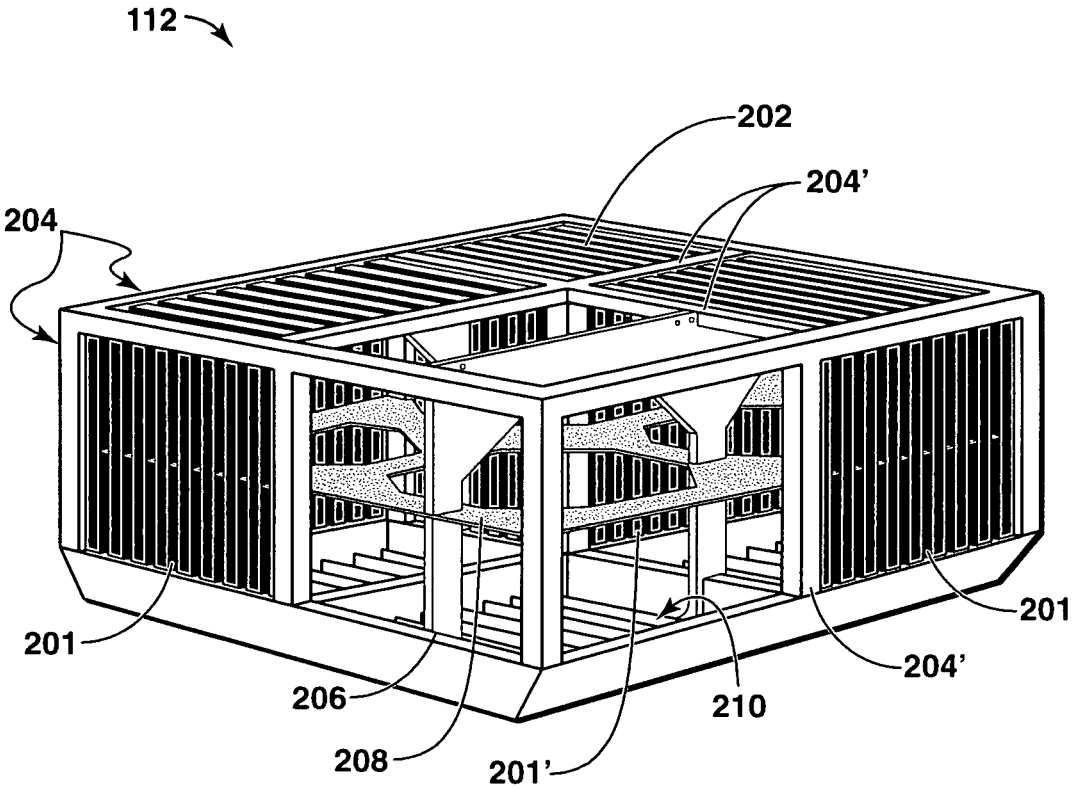
FIG. 2 illustrates an isometric or perspective view of one exemplary embodiment of the container of FIGS. 1A-1C including a partial cut-out view.

FIG. 2 illustrates an isometric or perspective view of one exemplary embodiment of the container 112 of FIGS. 1A-1C including a partial cut-away view. Accordingly, FIG. 2 may be best understood by concurrently viewing FIGS. 1A-1C. The longitudinal and transverse bulkheads or walls 201 of the container 112 are formed of corrugated material. The container 112 may also include at least one intermediate bulkhead 201', which is preferably corrugated. The top panels 202 are also preferably corrugated. The frame 204 includes longitudinal, transverse, and vertical members and may further include intermediate longitudinal, transverse, and vertical members 204'. The container optionally includes a deck girder 206 for each top panel 202 and a horizontal girder or stringer 208 for each side bulkhead or wall 201. The container 112 further includes a bottom assembly 210.

Figure 3B:
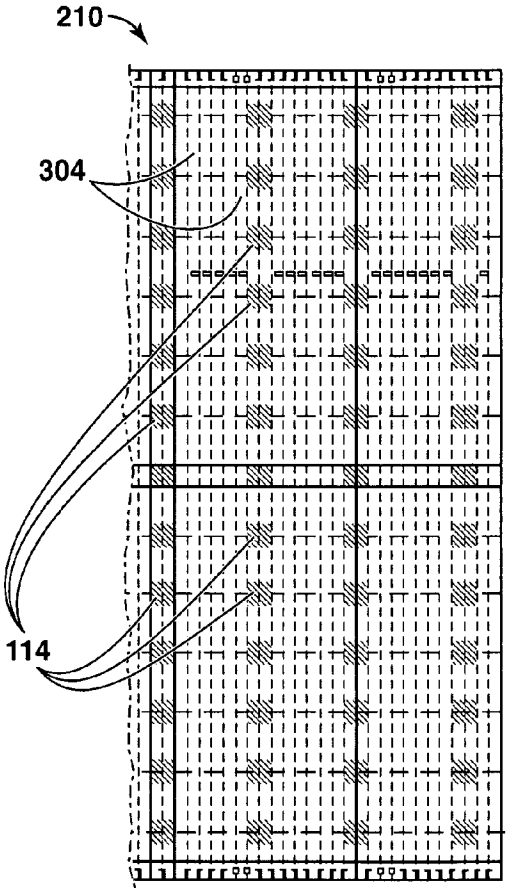
FIGS. 3A-3G are exemplary illustrations of various exemplary structural elements of one embodiment of the container of FIG. 2.
Figure 3A:
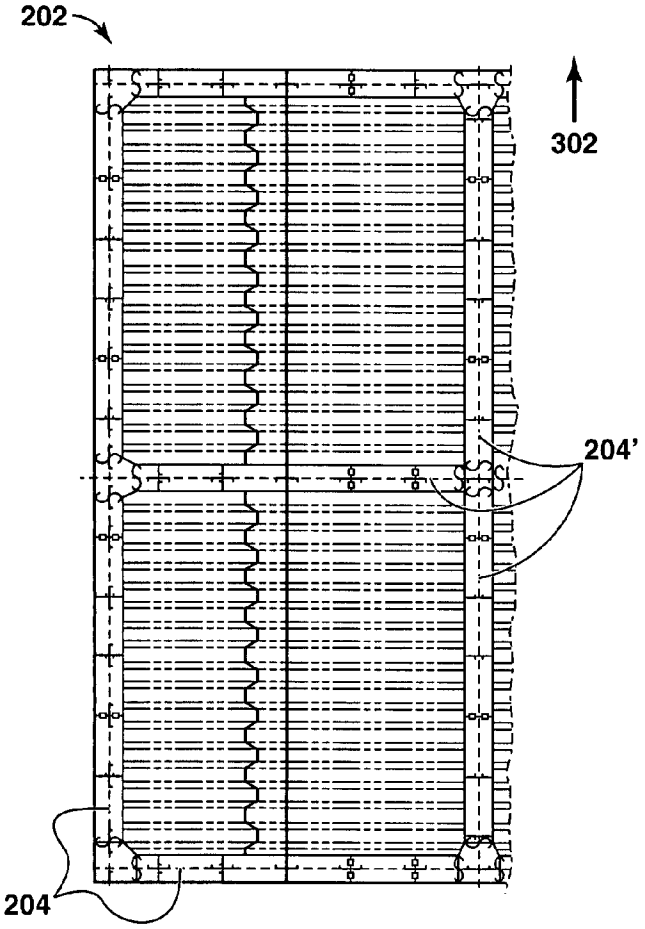

FIGS. 3A-3G illustrate elevation views of exemplary embodiments the various components of the independent container 112 of FIGS. 1A-1C and 2 of the present invention. Accordingly, FIGS. 3A-3G may be best understood by concurrently viewing FIGS. 1A-1C and 2. FIG. 3A illustrates an exemplary embodiment of the top portion 202 of the container 112, showing the frame 204 and optional intermediate frame members 204'. The axes of the corrugations is preferably transverse as shown by the arrow 302 indicating the bow or forward portion of the ship. Note that in some marine vessels, there may not be an apparent "forward portion," hence the orientation of the top portion 202 corrugations may not have significance.

FIG. 3B illustrates an exemplary embodiment of the bottom assembly (or portion) 210 of the container 112, showing the chocks 114 for supporting the container 112, and not showing corrugations. Note that chocks and/or blocks may also be placed at the top or sides 201 of the tank 112 to provide lateral support for the tank 112. As required by international regulations, chocks are also provided to prevent floating of the tanks 112 in the event of flooding in the hold due to, for example, a collision. Although various configurations may be used, one exemplary configuration may comprised a traditionally stiffened arrangement of girders and stiffeners (not shown). The bottom configuration may further include a trough or troughs 304 around the periphery of the chocks 114. In the event liquid leaks from the container 112, it may be collected in the troughs 304, which are preferably strategically located at low points on the tank 112 and adjacent to the support blocks 114. Note that the particular trough 304 configuration may vary significantly depending on the geometry of the marine vessel, type of liquid cargo, and other design considerations while still being within the spirit and scope of the present invention.

Figure 3C:
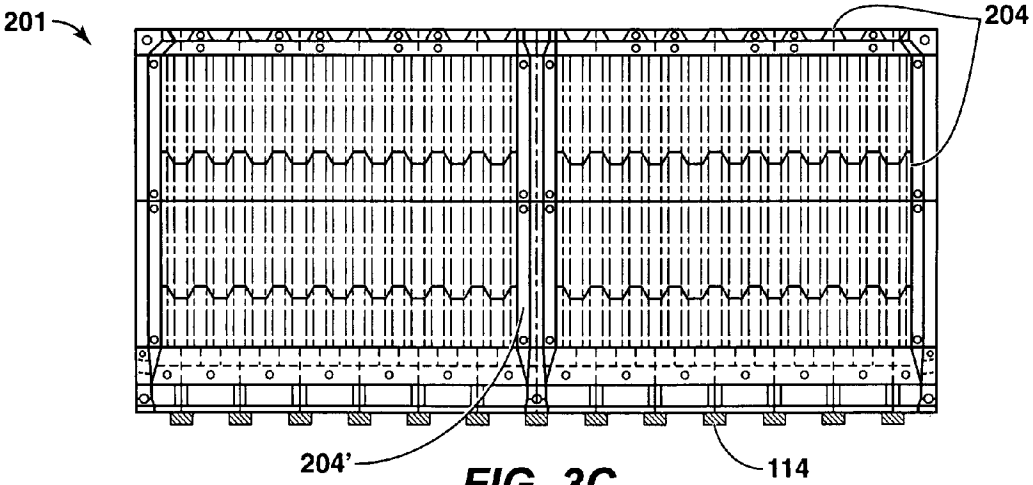

FIG. 3C illustrates an exemplary embodiment of one side wall or bulkhead 201 of FIG. 2 of the present invention. The axes of the side wall 201 corrugations are preferably vertically oriented for the longitudinal and transverse bulkheads 201, which provide structural support to the container 112. The corrugated form of the walls 201 also limits the impact of sloshing loads and facilitates contraction and expansion (deflection) of the walls 201 in the longitudinal and transverse directions (like an accordion), while limiting deflection in the vertical direction thereby reducing some of the thermal stresses in the container 112. This effect would be most advantageous for larger and particularly long containers 112. The very low temperatures of liquefied gases can cause significant thermal deflection of the container 112.

A planar wall would deflect equally in all directions rather than in substantially only one orientation, thereby increasing stress on the adjacent portions of the container 112.

Figure 3E:
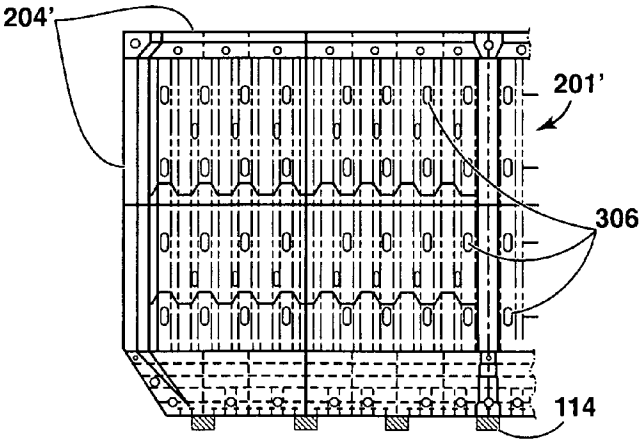
Figure 3D:
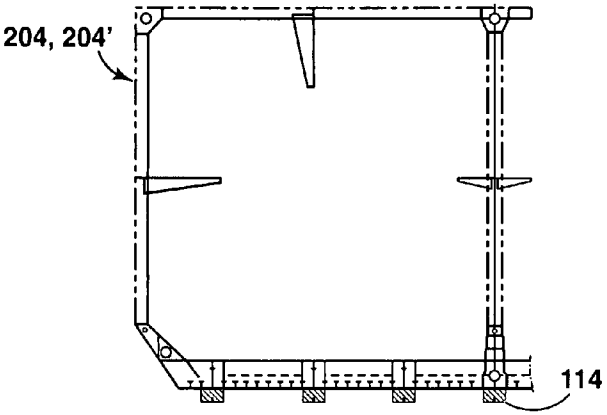

FIG. 3D illustrates an exemplary embodiment of one portion of the frame 204 of FIG. 2 of the present invention. The frame 204 may include intermediate members 204' placed between the primary members 204. The frame 204 is preferably formed from box girders configured to fixedly attach to the walls 201 and top portions 202 of the container 112. In one arrangement, each wall 201 and each top panel 202 is connected to the adjacent wall 201, top panel 202, or container bottom 210 through a box-girder 204. The box girders 204, 204' are configured to attach to the walls 201, 201', tank top 202, and tank bottom 210 and transmit bending stresses to the adjacent tank structure (e.g. the corrugated walls 201 of the tank). The box girders may comprise a variety of cross-sectional shapes (e.g. square, rectangle, triangle, etc.) depending on the configuration of the container 112, cost, and other considerations. The volume of the box girders 204 may be filled with liquid cargo to allow for extra cargo capacity and to allow for better temperature distribution within the container 112. Some embodiments of the storage container 112 are self-supporting and thus independent from the hull structure 110 of the vessel. Also, the tank 112 is preferably free to expand and contract with thermal or external loads.

FIG. 3E illustrates an exemplary embodiment of one intermediate wall 201' of FIG. 2 of the present invention. If the container 112 includes intermediate bulkheads or walls 201', these walls 201' preferably include perforations or holes 306 to permit the passage of liquid while providing structural integrity and reducing sloshing loads. These walls 201' may also be referred to as "swash" bulkheads 201'. Similar to the bulkheads 201, the intermediate bulkheads 201' preferably include corrugations with vertically oriented axes.

Figure 3F:
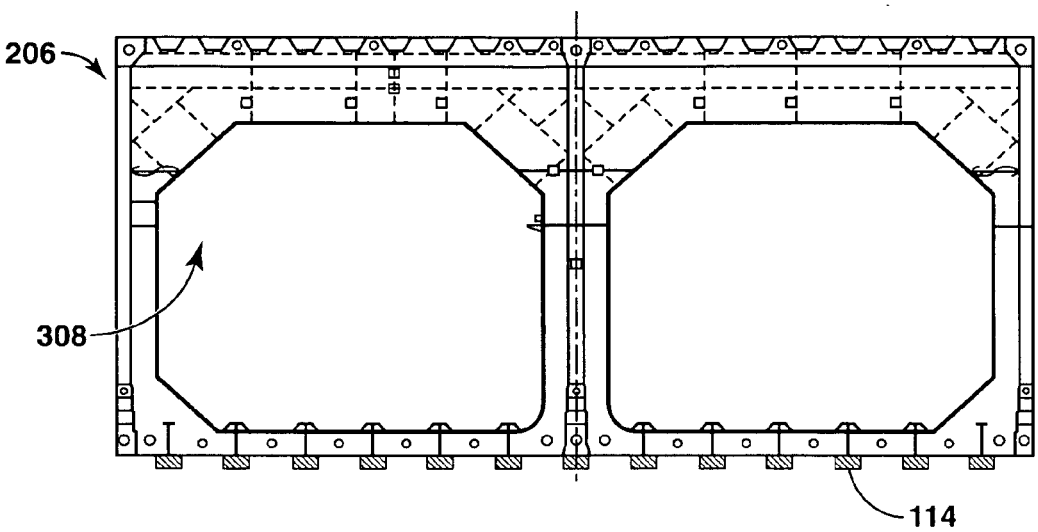
Figure 7:
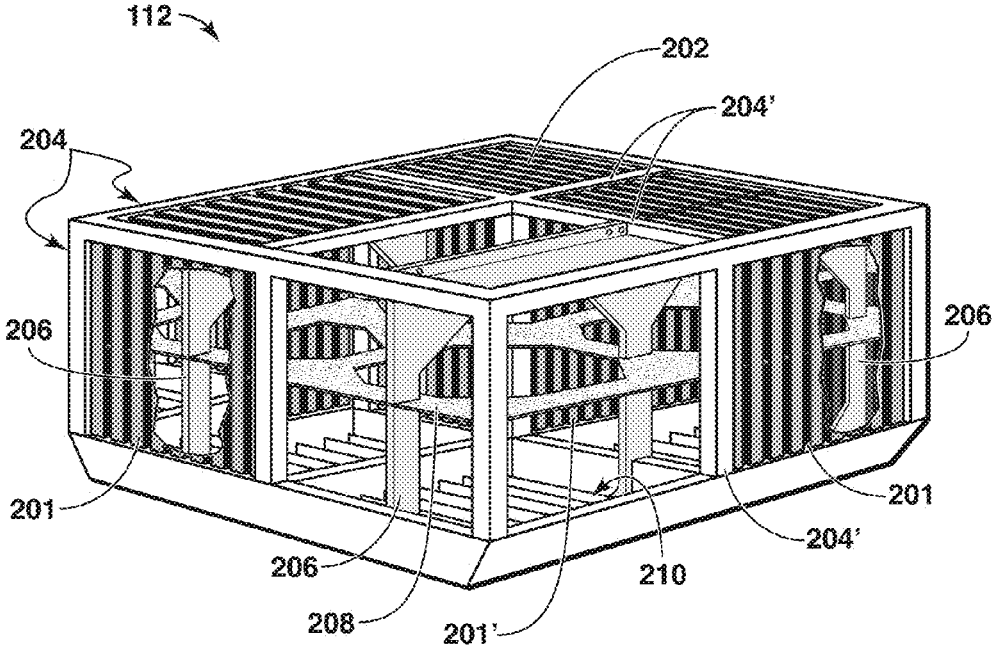
FIG. 7 illustrates an isometric or perspective view of one exemplary embodiment of the container of FIGS. 1A-1C including a partial cut-out view.
Figure 8:
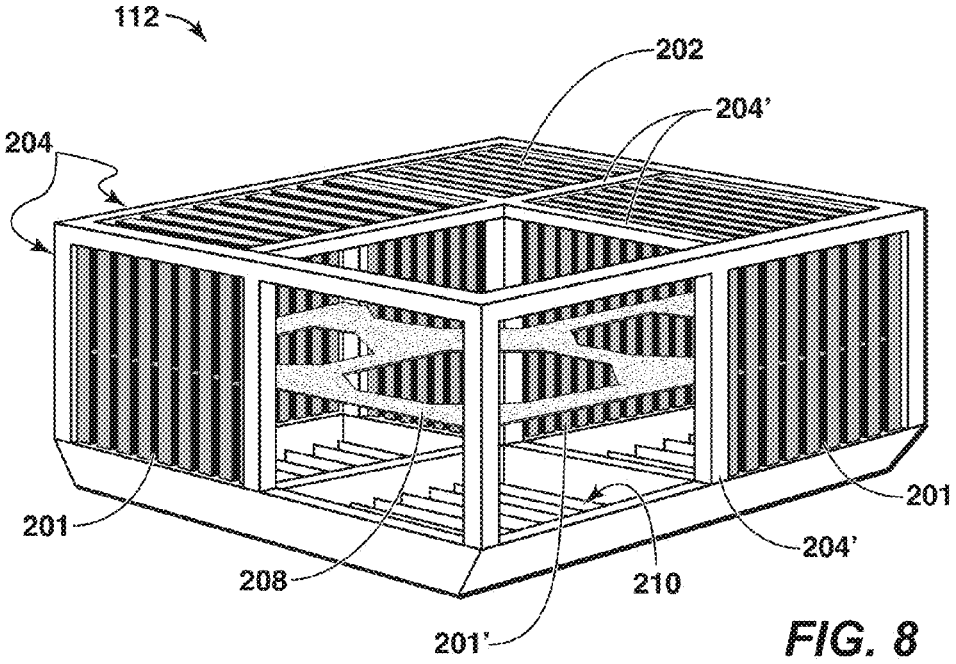
FIG. 8 illustrates an isometric or perspective view of one exemplary embodiment of the container of FIGS. 1A-1C including a partial cut-out view.

FIG. 3F illustrates an exemplary embodiment of an intermediate deck girder 206 of FIG. 2 of the present invention. Depending on the size of the container 112, there may not be an intermediate deck girder 206, or there may be one, two, or three or more deck girders 206. FIG. 8 illustrates an exemplary embodiment of the container 112 which does not include an intermediate deck girder 206. FIG. 7 illustrates an exemplary embodiment of the container 112 including two intermediate deck girders 206. The intermediate deck girder 206 is configured to impart additional structural integrity to the container 112 utilizing minimal additional construction and materials as well as providing additional resistance to sloshing loads. The internal shape 308 of the deck girder 206 may comprise a variety of configurations depending on the size and shape of the container 112, the amount of materials available, manufacturing processes, and other engineering design considerations.

Figure 3G:
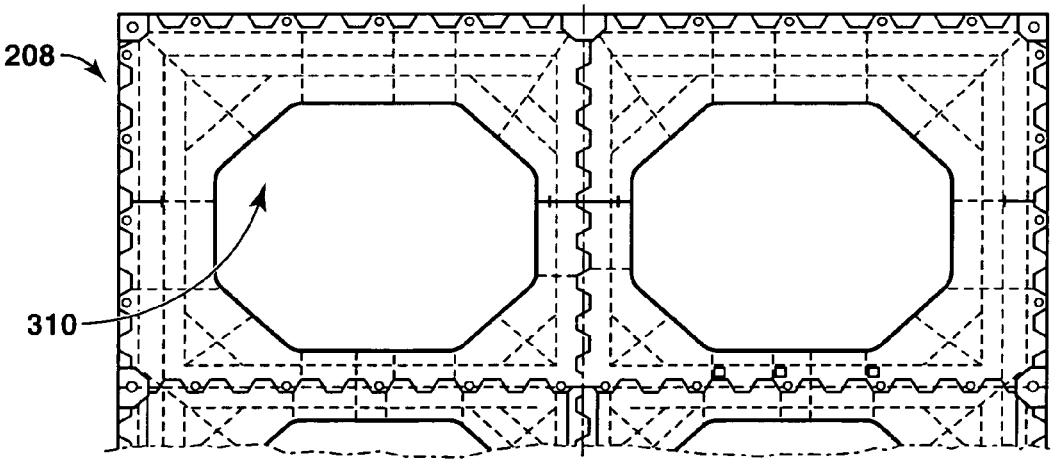
Figure 6:
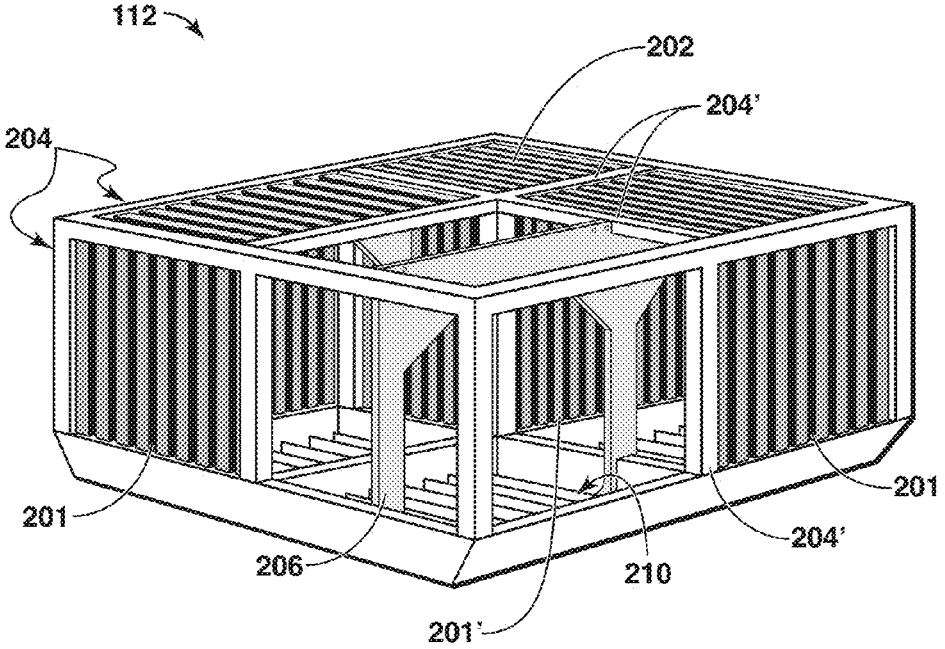
FIG. 6 illustrates an isometric or perspective view of one exemplary embodiment of the container of FIGS. 1A-1C including a partial cut-out view.

FIG. 3G illustrates an exemplary embodiment of an intermediate horizontal girder or stringer 208 of FIG. 2 of the present invention. As with the deck girder 206, there may be no need for the stringer 208, which is configured to provide additional structural integrity and decrease sloshing loads within the container 112. FIG. 6 illustrates an exemplary embodiment of the container 112 which does not include the stringer 208. The internal shape 310 of the stringer 208 may comprise a variety of configurations depending on the size and shape of the container 112, the amount of materials available, manufacturing processes, and other engineering design considerations.

Figure 4:
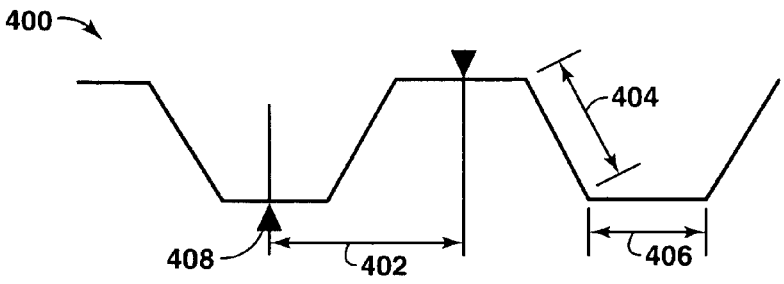
FIG. 4 is an exemplary illustration of a cross-section of a corrugation of the container of the present invention.

FIG. 4 illustrates an exemplary embodiment of a cross-section of a corrugation 400 utilized in the bulkheads 201, top portions 202, and intermediate bulkheads 201' of FIGS. 2, 3A, 3C, and 3E of the present invention. Accordingly, FIG. 4 may be best understood by concurrently viewing FIGS. 2, 3A, 3C, and 3E. The corrugation 400 comprises a width 402, a web having a length 404, and a flange having a length 406. In one exemplary embodiment, a single panel of corrugations may include a weld 408 such as a butt weld down the middle of the flange length 406. Note that other automated processes may also be used to provide a metallic bond between two corrugations 400.

The size and shape of the corrugations 400 may vary significantly depending on the size and shape of the container 112, the amount of materials available, manufacturing processes, and other engineering design considerations. As the web length 404 and flange length 406 are increased, the size of the corrugations 400 increase, which should result in increased structural support and decreased sloshing loads. In some embodiments the corrugations 400 may be large enough to eliminate the need for intermediate girders 206 or stringers 208. However, larger corrugations 400 may require wider frame members 204 and increase overall material and construction costs. In one preferred embodiment, the width 402 is greater than about 1,000 millimeters (mm), or greater than about 1,200 mm, or greater than about 1,300 mm; the web length 404 is greater than about 800 mm, greater than about 850 mm, greater than about 900 mm, greater than about 950 mm, or greater than about 1,000 mm; and the flange length 406 is greater than about is greater than about 800 mm, greater than about 850 mm, greater than about 900 mm, greater than about 950 mm, or greater than about 1,000 mm.

Figure 5:
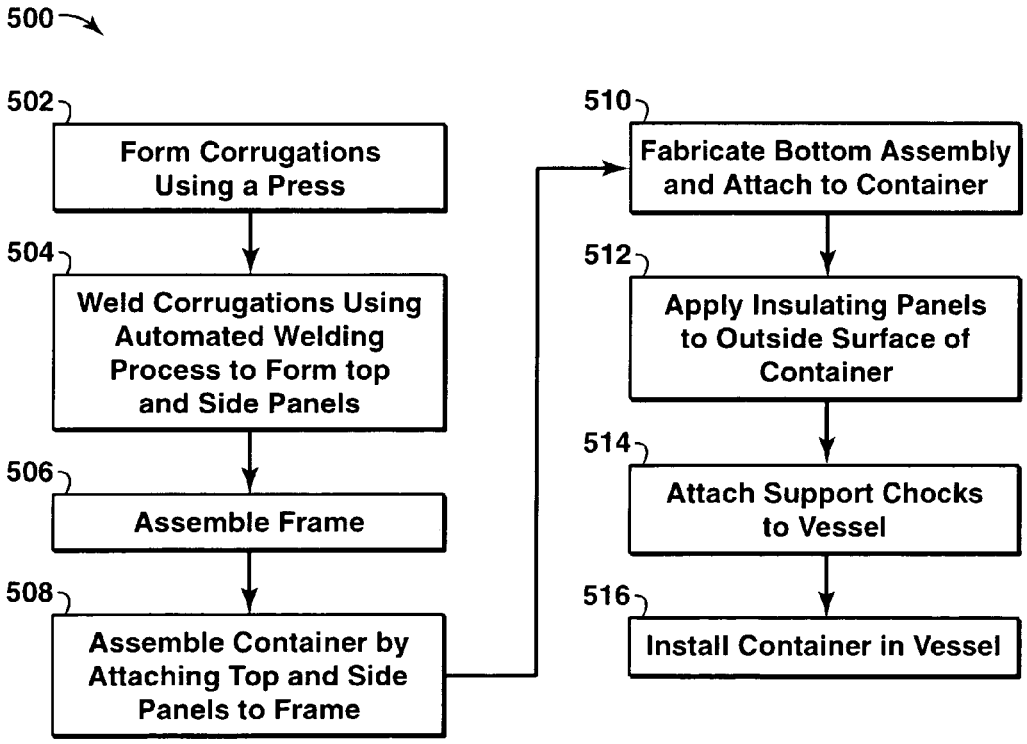
FIG. 5 is an illustration of a flow chart of an exemplary method of manufacturing the container of FIG. 2.

FIG. 5 illustrates a schematic diagram of an exemplary embodiment of one process of manufacturing the container 112 of FIGS. 2, 3A-3G, and 4 of the present invention. Accordingly, FIG. 5 may be best understood by concurrently viewing FIGS. 2, 3A-3G, and 4. Initially, the corrugations 400 may be formed using a press 502 or other automated machine, then the corrugations 400 may be joined using an automated process 504 to form the panels 201 and 202. The frame 204 may be assembled 506 separately, then fixedly attached 508 to the panels 201 and 202. The bottom assembly 210 may be separately manufactured 510 and then fixedly attached to the frame 204. Intermediate elements such as bulkheads 201', frame members 204', girders 206, and stringers 208, may also be attached to the frame 204, as appropriate. Next, insulating panels 118 are installed 512 and the support chocks 114 are attached 514 to the vessel and/or the container 112, then the container 112 is installed 516 into the vessel.

In some preferred embodiments, the panels 201 and 202 are prefabricated prior to installation in the frame 204. The full length of a single corrugation 400 is preferably fabricated from one single metal sheet with the folds or "knuckles" running along the length of the corrugation 400. With a sheet usually measuring between 4 and 5 meters in width, multiple corrugations 400 would be fabricated and then welded together using a highly automated process such as, for example, butt-welding. Thus, the corrugated bulkhead panels 201 and 202 would be fabricated without stiffeners. This pre-fabrication process is preferably highly automated resulting in lower labor costs than standard independent tank designs. For example, the preferred process should reduce the amount of labor intensive manufacturing processes, such as fillet welding, required to manufacture other independent tanks. For example, the IHI SPB tank may require nearly twice as much fillet welding over the present invention.

In some preferred embodiments, the material for the container 112 is a material providing good material properties at cryogenic temperatures. In particular, the container 112 may be formed from 9% nickel (Ni) steel or aluminum. More specifically, the container 112 may be formed from stainless steel (SUS304).

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the appended claims.

What is claimed is:

1. A storage container, comprising:

a support frame fixedly attached directly to at least one top panel, at least one bottom assembly, and a plurality of corrugated side panels having corrugations, wherein the support frame is externally disposed around the storage container;

wherein an interior surface of the at least one top panel, at least one bottom assembly, and plurality of side panels is an interior surface of the storage container and an exterior surface of the at least one top panel, at least one bottom assembly, and plurality of side panels is an exterior surface of the storage container;

wherein the support frame is configured to operably engage at least a portion of a hull of a marine vessel; and wherein the storage container is an enclosed, liquid-tight, self-supporting storage container capable of transporting liquefied gas.

2. The storage container of claim 1, wherein the support frame is configured to transmit a bending stress from at least one of the plurality of corrugated side panels to at least one of the at least one top panel.

3. The storage container of claim 1, wherein the support frame comprises a plurality of box girders.

4. The storage container of claim 1, wherein the storage container has a substantially prismatic geometry.

5. The storage container of claim 1, wherein the liquefied gas is liquefied natural gas.

6. The storage container of claim 1, wherein the support frame is configured to operably engage at least a portion of a hull of a marine vessel via chocks.

7. The storage container of claim 1, further comprising at least one intermediate bulkhead interior of the plurality of side panels of the storage container.

8. The storage container of claim 7, wherein the at least one interior intermediate bulkhead is corrugated and comprises at least one hole configured to pass the liquefied gas therethrough.

9. The storage container of claim 1, wherein the corrugations of the plurality of corrugated side panels have a substantially vertical orientation.

10. The storage container of claim 1, further comprising an intermediate girder, an intermediate stringer, or a combination of an intermediate girder and an intermediate stringer interior of the plurality of side panels of the storage container.

11. The storage container of claim 1, wherein the plurality of corrugated side panels are assembled by an automated process.

12. The storage container of claim 11, wherein the automated process is butt welding.

13. The storage container of claim 1, wherein the storage container is constructed from at least one of stainless steel, nickel alloy steel, and aluminum.

14. The storage container of claim 1, wherein the storage container is constructed from SUS304 stainless steel.

15. The storage container of claim 1, wherein the corrugations of the plurality of corrugated side panels comprise a flange and a web, each having a length, wherein the flange length and the web length are each greater than about 800 millimeters.

16. The storage container of claim 15, wherein the flange length and the web length are each greater than about 900 millimeters.

17. The storage container of claim 1, further comprising at least one insulating panel comprising an insulating material around at least a portion of the exterior of the storage container.

18. The storage container of claim 17, wherein the at least one insulating panel comprises a liquid-tight secondary barrier.

19. The storage container of claim 1, wherein the marine vessel is one of a ship; a floating storage and regasification unit, a gravity based structure, and a floating production storage and offloading unit.

20. The storage container of claim 1, further comprising at most one interior intermediate horizontal stringer.

21. The storage container of claim 20, wherein the container does not have an interior intermediate horizontal stringer.

22. The storage container of claim 1, further comprising only two interior intermediate deck girders.

23. The storage container of claim 20, further comprising only two interior intermediate deck girders.

24. The storage container of claim 21, wherein the container does not have an interior intermediate deck girder.

25. The storage container of claim 1, further comprising only one interior intermediate deck girder.

26. The storage container of claim 20, further comprising only one interior intermediate deck girder.

* * * * *